US009965913B2

(12) United States Patent
Ashley

(10) Patent No.: US 9,965,913 B2
(45) Date of Patent: May 8, 2018

(54) DEVICE AND METHOD FOR THE SENSING OF MONEY ITEMS

(71) Applicant: Crane Payment Solutions Limited, Lancashire (GB)

(72) Inventor: Tony Ashley, West Yorkshire (GB)

(73) Assignee: Crane Payment Innovations Limited, Oldham, Lancashire (GB)

( * ) Notice: Subject to any disclaimer, the term of this patent is extended or adjusted under 35 U.S.C. 154(b) by 0 days. days.

(21) Appl. No.: 15/326,643

(22) PCT Filed: Jun. 29, 2015

(86) PCT No.: PCT/GB2015/051885

§ 371 (c)(1),
(2) Date: Jan. 16, 2017

(87) PCT Pub. No.: WO2016/009171

PCT Pub. Date: Jan. 21, 2016

(65) Prior Publication Data

US 2017/0206727 A1 Jul. 20, 2017

(30) Foreign Application Priority Data

Jul. 16, 2014 (GB) ..... 1412631.2

(51) Int. Cl.
*G07D 5/08* (2006.01)
*G07D 5/00* (2006.01)

(52) U.S. Cl.
CPC ..... *G07D 5/08* (2013.01); *G07F 3/025* (2013.01)

(58) Field of Classification Search
CPC .. G07D 5/08; G07D 11/0036; G07D 2205/00; G07F 3/025; H03L 7/00
See application file for complete search history.

(56) References Cited

U.S. PATENT DOCUMENTS 6,076,651 A 6/2000 Furneaux
6,536,578 B1 * 3/2003 Ashley ..... G07D 5/08 194/318
2009/0242354 A1 10/2009 Miyauchi et al.
2014/0049273 A1 2/2014 Rocznik

FOREIGN PATENT DOCUMENTS

DE 2034426 A1 3/1971
GB 2308004 A 6/1997

OTHER PUBLICATIONS

Notification of Transmittal of the International Search Report and the Written Opinion of the International Searching Authority dated Sep. 7, 2015 in connection with International Application No. PCT/GB2015/051885, 10 pages.
Search Report dated Jan. 20, 2015 in connection with British Application No. 1412631.2, 3 pages.

* cited by examiner

*Primary Examiner* — Mark J Beauchaine

(57) ABSTRACT

An apparatus comprising a money item sensor comprising an electrical oscillator operable at a plurality of different oscillating frequencies to sense at least one property of money items. The oscillator is configured to trigger changes in the oscillating frequency synchronously with the beginning of a new frequency cycle of the oscillator.

12 Claims, 5 Drawing Sheets

DEVICE AND METHOD FOR THE SENSING OF MONEY ITEMS

CROSS-REFERENCE TO RELATED APPLICATION(S)

The present application claims priority under 35 U.S.C. § 365 to International Patent Application No. PCT/GB2015/051885 filed Jun. 29, 2015, entitled "DEVICE AND METHOD FOR THE SENSIG OF MONEY ITEMS", and through International Patent Application No. PCT/GB2015/051885, to British Application No. 1412631.2, filed Jul. 16, 2014, each of which are incorporated herein by reference into the present disclosure as if fully set forth herein.

FIELD

This specification relates to money item sensors. Particularly, but not exclusively, the specification relates to an electromagnetically inductive money item sensor in which an oscillator is configured to synchronously switch between different frequencies of oscillation.

BACKGROUND

Electromagnetic sensors for validating money items such as coins may use oscillator circuits to determine properties of the money items.

SUMMARY

This specification provides an apparatus comprising a money item sensor comprising an electrical oscillator operable at a plurality of different oscillating frequencies to sense at least one property of money items; wherein the oscillator is configured to trigger changes in the oscillating frequency synchronously with the beginning of a new half-cycle of the oscillator.

The apparatus may further comprise a controller for selecting a new oscillating frequency of the oscillator.

The controller may be configured to provide an indication of the new oscillating frequency to the oscillator.

The oscillator may be configured to trigger a change to the new oscillating frequency in response to receiving the indication of the new oscillating frequency from the controller.

The sensor may be configured to change the oscillating frequency of the oscillator by causing an alteration to a property of the oscillator.

The sensor may be configured to change the oscillating frequency of the oscillator by causing a change in a component configuration of the oscillator.

Changing the component configuration of the oscillator may comprise selectively varying the operation of at least one circuit component in the oscillator.

The at least one circuit component may comprise an electrically inductive component.

Changing the component configuration of the oscillator may comprise selectively switching at least one circuit component into the oscillator.

Changing the component configuration of the oscillator may comprise selectively switching at least one circuit component out of the oscillator.

The at least one circuit component may comprise a capacitive component.

The oscillator may comprise a resonant oscillator circuit.

The oscillator may be configured to trigger changes in the oscillating frequency synchronously with an instant of zero electrical current in the resonant oscillator circuit.

At the instant of zero electrical current, the electrical energy in the oscillating circuit may be stored in one or more resonant capacitors.

The resonant circuit may comprise an LC resonant circuit.

The apparatus may be configured to measure fluctuations in the waveform of the oscillator caused by a money item in a magnetic field generated by the oscillator to determine the at least one property of the money items.

This specification also provides an apparatus according to any preceding claim, configured to measure a first fluctuation in the oscillating frequency of the oscillator at a first base frequency of the oscillator to determine a first property of a money item; and measure a second fluctuation in the oscillating frequency of the oscillator at a second base frequency of the oscillator to determine a second property of the money item following a change in the base oscillating frequency.

The apparatus may be located in proximity to a money item guide path to determine the at least one property of money items moving along the guide path.

The money items may be electrically conductive.

The money items may be world coins.

This specification also provides a money item handling apparatus comprising the apparatus.

This specification also provides a method of sensing the properties of money items, comprising, in a money item sensor comprising an electrical oscillator operable at a plurality of different oscillating frequencies, causing the oscillator to trigger changes in the oscillating frequency synchronously with the beginning of a new half-cycle of the oscillator.

BRIEF DESCRIPTION OF THE DRAWINGS

For the purposes of example only, embodiments are described below with reference to the accompanying figures in which.

DETAILED DESCRIPTION

An apparatus 1 for determining properties of electrically conductive money items such as coins is explained below. The properties of the money items are determined based on how the money items affect an electromagnetically inductive sensor 2 as they pass through a magnetic field generated by an oscillator 3 in the sensor 2. The oscillator 3 is configured to switch between different base frequencies of oscillation to allow the apparatus 1 to determine different properties of the money items. Following a switch in base frequency, the oscillator 3 stabilises very quickly at the new frequency. The lack of any significant stabilisation time following such a frequency transition allows the sensor 2 to make a series of rapid transitions between different base frequencies, which in turn allows rapid determination of a plurality of different properties of a money item as it passes the sensor 2.

Figure 1:
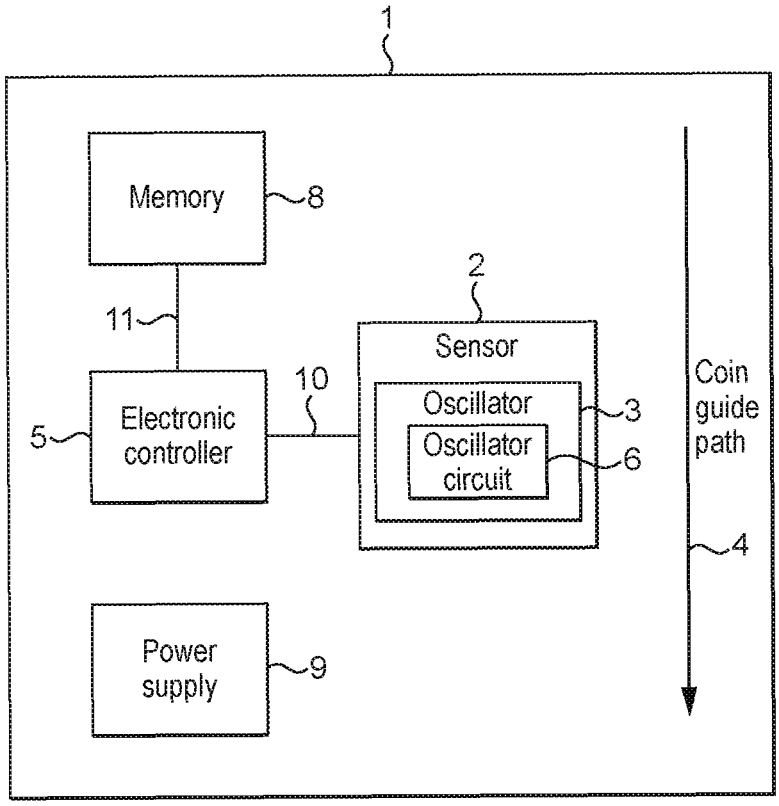
FIG. 1 is a schematic illustration of a money item handling apparatus comprising an electromagnetically inductive sensor for sensing the properties of money items.

A schematic diagram of the apparatus 1 is shown in FIG. 1. The apparatus 1 may be a money item handling apparatus for receiving and/or paying out money items. As illustrated in FIG. 1, the apparatus 1 comprises a guide path 4 along which money items are guided inside the apparatus 1.

The guide path 4 may, for example, be a money item inlet path or a money item outlet path. Alternatively, the guide path 4 may be a path of a money item conveyor or may be a path along which money items are guided inside a denominator or validator module. The electromagnetically inductive sensor 2 may be configured to sense the properties of money items as they move along the guide path 4.

For example, the sensor 2 may be located in or adjacent to the guide path 4 so that the sensor 2 generates a magnetic field in the guide path 4. The sensor 2 is configured to sense the properties of money items by detecting changes in the sensor 2 caused by the money items moving through the magnetic field. The sensor 2 is configured to generate signals which are indicative of the sensed properties so that the properties can be determined by analysis of the signals. The apparatus 1 and the sensor 2 may operate under the control of an electronic controller 5, such as a microcontroller, which controls the operation of the apparatus 1 and the sensor 2. This controller 5 may be configured to perform the analysis of the signals. The sensor 2 is driven by an oscillator circuit 6 and powered by a power supply 9. The controller 5 receives signals from the circuit 6 and instructs the circuit 6 to resonate at selected frequencies through connection 10.

Figure 2:
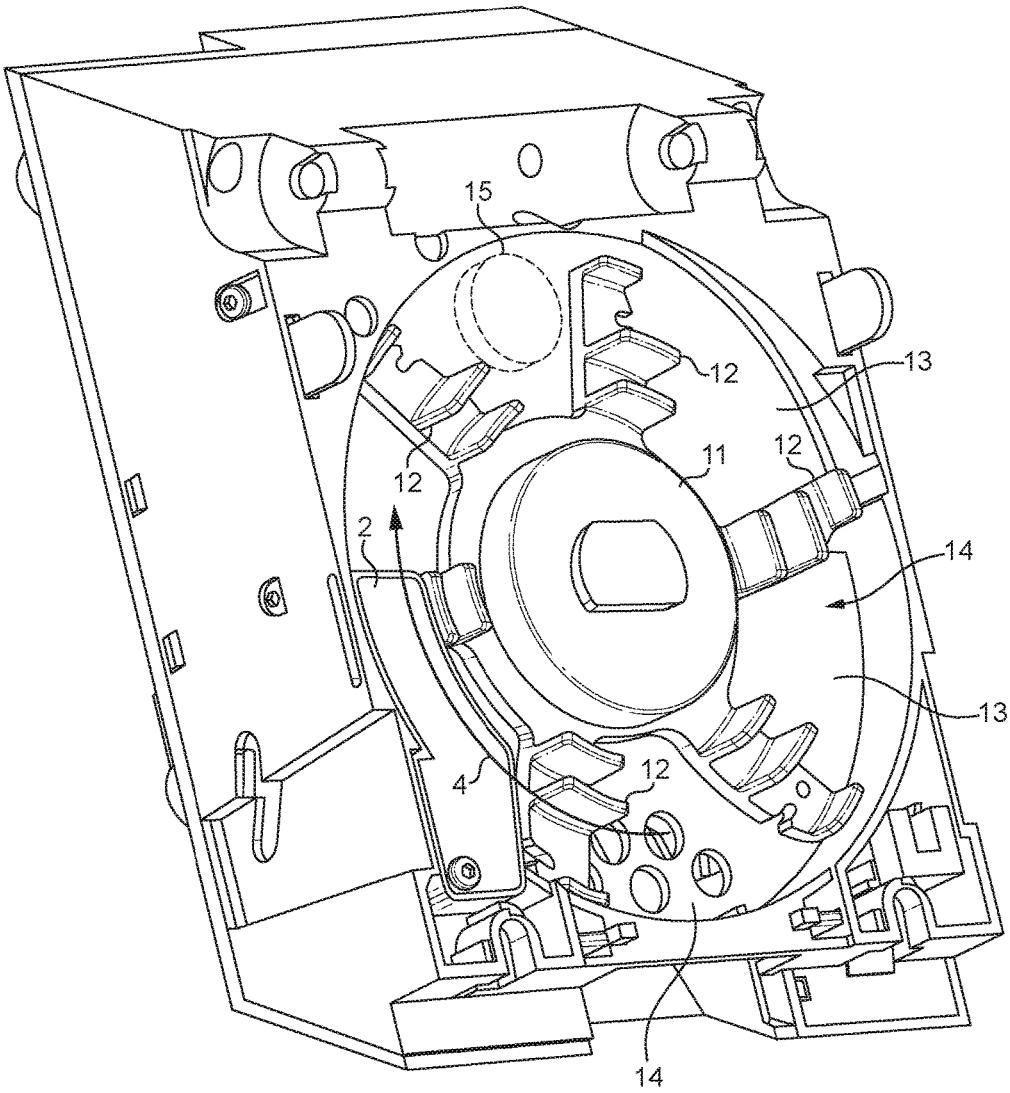
FIG. 2 is an illustration of a money item validator comprising an electromagnetically inductive sensor for sensing the properties of money items as they pass the sensor on a money item guide path.

An example of a suitable position for the sensor 2 in an approximately circular guide path 4 of a rotary money item validator module is illustrated in FIG. 2. As can be seen, the sensor 2 is located in the proximity of the guide path 4 so that the main faces of the money items pass directly beneath the sensor 2 as they are conveyed around the circular path 4. In the device of FIG. 2, the coins are moved along the path 4 by a rotary element ii driven by a motor (not shown) that has radially extending arms 12 that slide over an annular support surface 13 and define receptacles 14 to receive and convey individual coins past the sensor 2 on path 4. A coin 15 is shown schematically in dotted outline in one of the receptacles 14.

Figure 3:
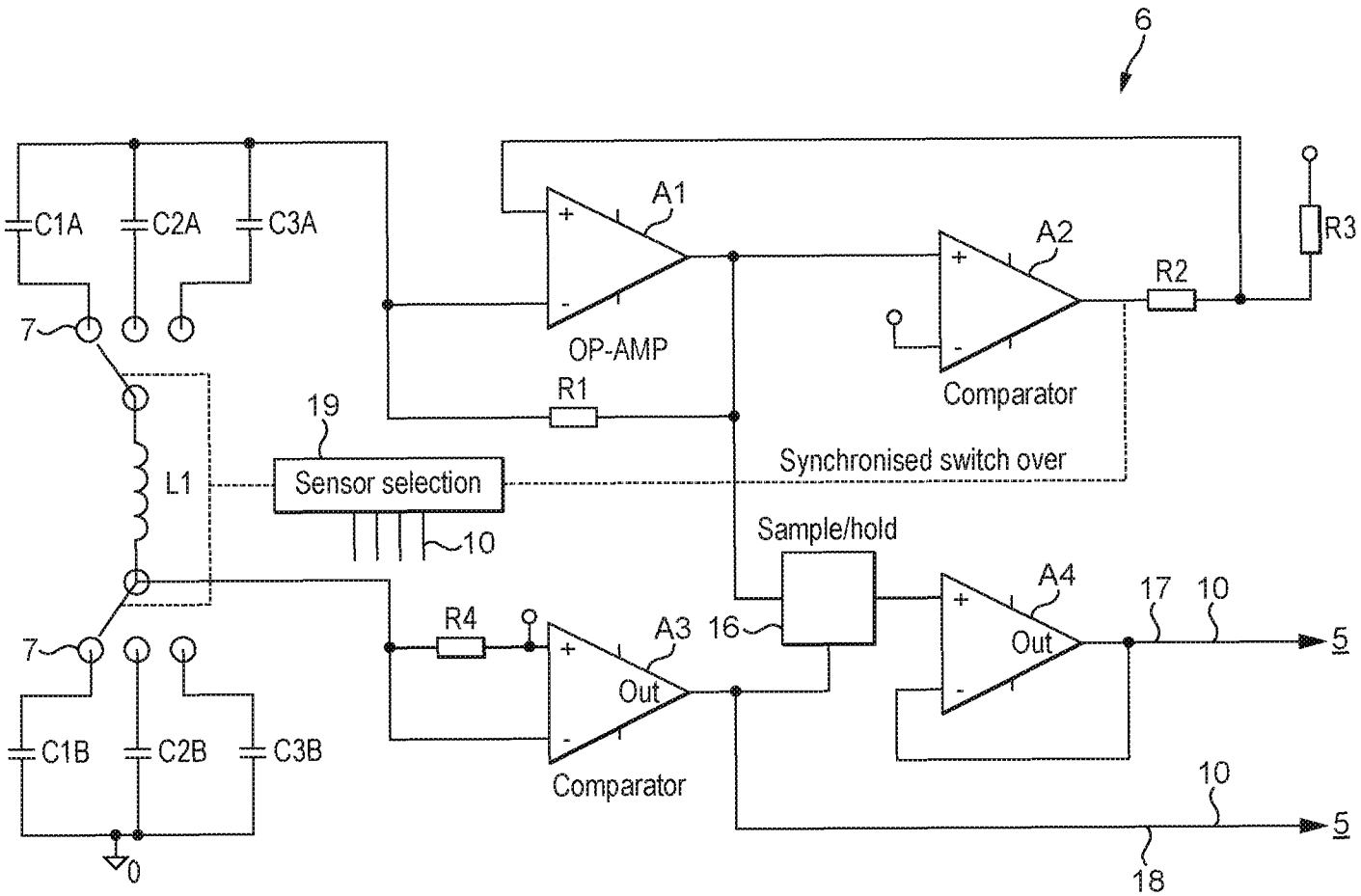
FIG. 3 is a schematic diagram of an electrical oscillator circuit operable at a plurality of different frequencies to sense the properties of money items.

As referred to above, the sensor 2 comprises an oscillator 3 for generating the magnetic field. Referring to FIG. 3, the oscillator 3 may comprise an electrical oscillator circuit 6, the oscillating frequency of which is dependent on, and varies with, the electrical characteristics of a money item sensing element L1. The money item sensing element L1 has electrical characteristics which are temporarily varied by the electromagnetic effect of money items as the money items move through the magnetic field created by the oscillator 3. For example, the money item sensing element L1 may comprise an electromagnetically inductive element such as an inductive coil or other winding.

As shown in FIG. 3, the oscillator circuit 6 may be based on a series resonant circuit. The illustrated circuit 6 comprises a money item sensing element L1 in the form of an inductor and a plurality of resonant capacitive elements C1-3A/B. Each resonant capacitive element C1-3A/B may be in the form of one or more capacitors. The money item sensing element L1 can be selectively connected to each of the resonant capacitive elements C1-3A/B in the circuit 6. For example, as shown in FIG. 3, the circuit 6 may comprise one or more switches 7 for selectively connecting and disconnecting the money item sensing element L1 to and from different ones of the capacitive elements C1-3A/B. Thus, the sensor 2 comprises the inductive sensing element L1 for forming an inductive coupling with the money item to be tested, connected in series between first and second capacitive elements C1-3A/B in a self oscillating, resonant circuit, and a detector is provided as described below to detect changes in oscillatory characteristics of the circuit as the coin passes the inductor.

As indicated previously, the sensor 2, and in particular the money item sensing element L1, is located in the proximity of the money item guide path 4 of the money item handling apparatus 1. Money items moving along the guide path 4 through the magnetic field created by the oscillator 3 cause a detectable change in the electrical characteristics, such as the impedance or reactance, of the money item sensing element L1. Therefore, when a money item moves past the money item sensing element L1, the oscillating frequency of the oscillator 3 is temporarily altered from its base frequency in a manner which is related to at least one property of the money item.

The sensor 2 is configured to generate an output signal which is proportional to and/or indicative of the changes in the oscillating frequency of the oscillator 3. The output signal of the sensor 2 reflects alterations in the electrical characteristics of the money item sensing element L1 and thus the properties of money items in the guide path 4. For example, a fluctuation, representative of a change in the electrical characteristics of the money item sensing element L1, may be observed in the output signal of the sensor 2 when a money item passes the sensing element L1. The output signal may, for example, comprise an output voltage signal of the oscillator circuit 6.

The output voltage signal for the sensor 2 may be developed by means of an arrangement of amplifiers A1-A4 shown in FIG. 3. Amplifiers A1 and A4 are operational amplifiers whereas A2 & A3 are voltage comparators. A sample and hold circuit that in dudes a switch and a storage capacitor is configured to sample the output of A1, which is then fed via amplifier A4 as an output on line 17 to the electronic controller 5 via connection 10.

Amplifier A1 drives a square wave across the series resonant network formed by sensor L1 and the selected capacitors C1-3A/B. The output voltage of A1 is proportional to the current flowing through its feedback resistor R1, which is the same as the current flowing through the resonant network. Since the circuit is at resonance, the current and voltage are in phase.

Comparator A2 squares up the sine wave output of A1 and acts as a voltage limiter. By feeding a small proportion of the output of amplifier A2 back through divider resistors R2, R3 onto the non-inverting (+) input of A2, A1 can be kept operating in a linear mode rather than saturating.

The edges of the digital signal coming from A2 correspond with the points of zero current in the sensor L1 and so the rising edge of A2 can be used to synchronously switch over the capacitor selection switches 7 by clocking through digital values placed on the latch 19 by the electronic controller 5 through connection 10.

Comparator A3 squares up the voltage on the lower selected capacitor C1-3B. Because the voltage across the capacitor lags the current in L1 by 90 degrees, the rising edge of the output of A3 corresponds with the minimum voltage of the signal on A1.

This edge is integrated to form a narrow pulse, which briefly closes the switch of sample/hold circuit 16 to grab the minimum value of A1's output. This demodulator can track the amplitude changes of A1 very rapidly.

Amplifier A4 is a high impedance buffer to buffer the voltage held on the sample/hold capacitor and provide the output on line 17. A signal corresponding to the frequency of the oscillator 3 can fed to the controller 5 on line 18.

The money item handling apparatus 1 may be configured to determine the properties of the money items from the specifics of the changes in the output signal of the sensor 2. For example, the apparatus 1 may be configured to determine properties such as money item thickness, money item diameter and material construction. Optimum determination of the different money item properties may be best facilitated by subjecting all money items to a plurality of different base frequencies of magnetic field as the money items pass the money item sensing element L1. The apparatus 1 may be configured to take readings of the sensor's output signal at each different field frequency in order to optimally determine the various properties of each money item. As explained further below, the sensor 2 is configured to create the different frequencies of magnetic field by changing the base oscillating frequency of the oscillator 3.

The sensor 2 may be configured to feed its output signal to the electronic controller 5 referred to above and shown in FIG. 1. The controller 5 may be configured to analyse the signal, for example by comparing the signal characteristics to known money item characteristics stored in a memory 8 of the apparatus 1, to determine the properties of the sensed money items. This may allow the apparatus 1 to validate the money items as being either genuine or non-genuine.

The sensor 2 is operable to produce a plurality of base oscillating frequencies using the same oscillator 3 and money item sensing element L1. This is advantageous because the size envelope available in money item handling apparatuses 1 is often very limited and so the use of a single oscillator 3 to produce all of the different frequencies avoids the need to allocate additional envelope space to multiple sensors dedicated to single frequencies. There is also a saving in terms of component costs. Furthermore, the ability of the sensor 2 to produce all of the different oscillating frequencies means that any error associated with the oscillator 3 is consistent for all measurements. This can reduce the complexity of determining the properties of the sensed money items.

As explained below, the sensor 2 is configured to cause the transitions between the different oscillating frequencies to take place in a manner which makes the oscillator 3 stabilise very rapidly at the new oscillating frequency. The rapid stabilisation of the oscillator 3 following a frequency transition allows the apparatus 1 to take multiple readings at different base frequencies within the short period of time it takes for a money item to move past the sensor 2.

The sensor 2 is configured to change the base frequency of the oscillator 3, and thus the magnetic field, by modifying the component configuration of the oscillator 3. For example, as will be described in more detail below, the oscillator 3 may be modified by switching one or more circuit components into or out of the oscillator circuit 6 in order to alter the properties of the circuit 6.

Referring to FIG. 3, the sensor 2 may be operable to change the base oscillating frequency of the oscillator 3 by alteration of the circuit connections between the money item sensing element L1 and the resonant capacitive elements C1-3A/B described above. In the oscillating circuit 6 of FIG. 3, there are three resonant capacitive elements C1-3A/B provided in the form of three pairs of resonant capacitors C1A&B, C2A&B, C3A&B. Each capacitive element C1-3A/B has a different capacitance and can be individually connected to the inductive sensing element L1 by operation of the two illustrated switches 7 in order to obtain a corresponding number of different oscillating frequencies f1-f3 of the oscillator 3. It will be appreciated that the number of capacitive elements is not limited to three and, furthermore, that each capacitive element may comprise a greater or fewer number of capacitors to those illustrated in FIG. 3.

The selection of the component configuration of the oscillator 3 may be controlled by the controller 5. For example, the controller 5 may be configured to cause the oscillator circuit 6 to adopt a series of different circuit configurations in sequence in order to allow the sensor 2 to determine different properties of a money item under test as it passes the sensor 2. The sequence of different configurations may be stored in the memory 8 of the apparatus 1.

The timing of the changes between the different component configurations may be triggered by the oscillator 3 itself based on the flow of electrical charge in the oscillator circuit 6. The oscillator 3 may be configured to trigger changes in the configuration of the oscillator circuit 6, and hence changes in the base oscillating frequency of the oscillator 3, at moments when the electrical current in the money item sensing element L1 is zero and all of the electrical energy in the circuit 6 is instead stored in the resonant capacitive elements C1-3A/B.

At a moment when the current in the money item sensing element L1 is zero, for example at the start of a new positive half cycle of the oscillator 3, the oscillator 3 may change the configuration of the oscillator circuit 6 by causing the switches 7 to switch one or more of the resonant capacitive elements C1-3A/B out of the oscillator circuit 6. In this situation, the electrical energy that was held in these resonant capacitive elements C1-3A/B at the moment they were switched out of the oscillator circuit 6 continues to be held in the form of voltages across the capacitive elements C1-3A/B until such a time as the capacitive elements C1-3A/B are switched back into the circuit 6 by a further change in the circuit configuration.

Figure 4:
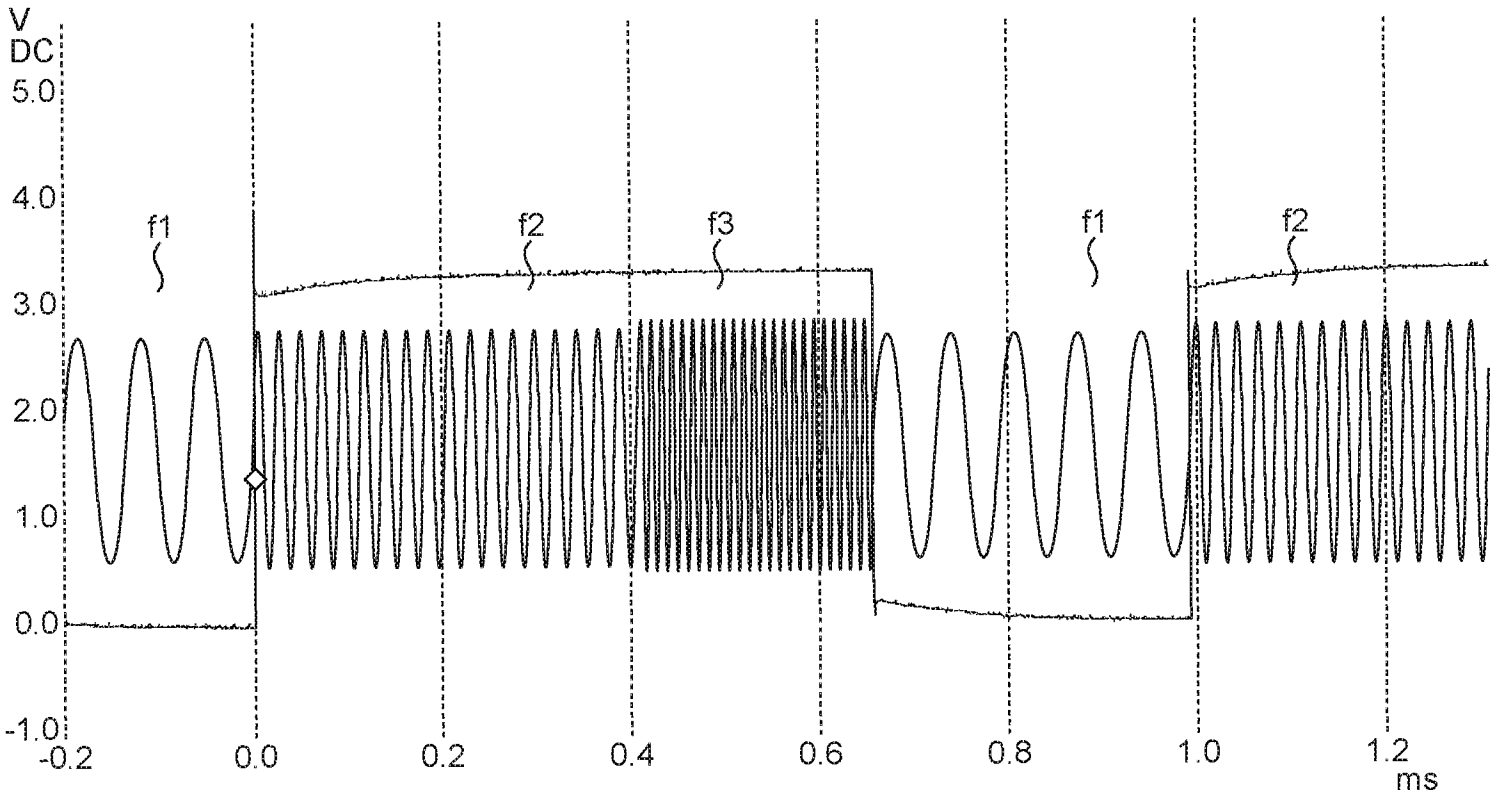
FIG. 4 is a plot of changes in the oscillating frequency of an electromagnetically inductive sensor for sensing the properties of money items.

For example, referring to FIGS. 3 and 4, the controller 5 may be configured to cause the oscillator 3 to transition from a first circuit configuration, in which a first capacitive element C1A&B is coupled to the money item sensing element L1, to a second circuit configuration, in which a second capacitive element C2A&B is coupled to the money item sensing element L1. The difference in capacitance between the first capacitive element C1A&B and the second capacitive element C2A&B causes the oscillating frequency of the circuit 6 to change from a first frequency f1 to a second frequency f2. The oscillator 3 triggers the transition synchronously with the beginning of a new half-cycle of the oscillator 3, when the electrical energy of the circuit 6 is stored in the first capacitive element C1A&B.

At a later time, the controller 5 may be configured to cause the oscillator 3 to transition back to the first circuit configuration in order to re-establish the first oscillating frequency f1. As can be seen from FIG. 4, upon the first circuit configuration being re-established at the beginning of a new oscillation cycle, the waveform of the oscillator 3 stabilises very quickly at the first frequency f1. In particular, the amplitude of the waveform stabilises very quickly at the same magnitude as when the first circuit configuration was previously in place. This is due to the maximum amount of circuit energy being stored in the first capacitive element C1A&B during the period in which the oscillator 3 was operating in other configurations. It can be seen from FIG. 4 that this rapid stabilisation effect is present each time the oscillator 3 triggers a transition to a new circuit configuration; the amplitude of the waveform at the new oscillating frequency f1, f2, f3 stabilises very quickly due to the previously stored circuit energy being released from the capacitive element C1-3A/B associated with the new circuit configuration.

It can be seen from FIG. 4 that the oscillator 3 triggers each change synchronously with the beginning of a new positive half cycle of oscillation, at a moment when all electrical energy is stored in the capacitive elements C1-3A/B and the current in the circuit 6 is zero. The oscillator 3 stabilises almost immediately at the new base frequency, allowing the apparatus 1 to almost immediately begin sampling the output signal of the sensor 2 to determine one or more money item properties from fluctuations in the new base frequency. There is no requirement for the apparatus 1 to delay sampling the output signal for a period of time after the frequency transition in order to allow the oscillator 3 to settle at the new frequency.

The sensor 2 is configured to cause the oscillator 3 to trigger the changes in circuit configuration that are communicated to it by the controller 5. Once the circuit transitions have been triggered, the sensor 2 is configured to generate a feedback signal for the controller 5 to inform the controller 5 that the transition has taken place and the oscillator 3 is oscillating at the new base frequency. The controller 5 may use the information in the feedback signal to begin make readings of the output signal of the sensor 2 at the new frequency in order to determine a money item property that is particularly determinable from the new frequency.

The controller 5 may select new configurations for the oscillator 3 at regular time intervals, such as every 200 to 400 microseconds, in order to cause the rapid changes in the oscillating frequency. The exact component configuration of the oscillator 3 is always known to the controller 5.

Figure 5:
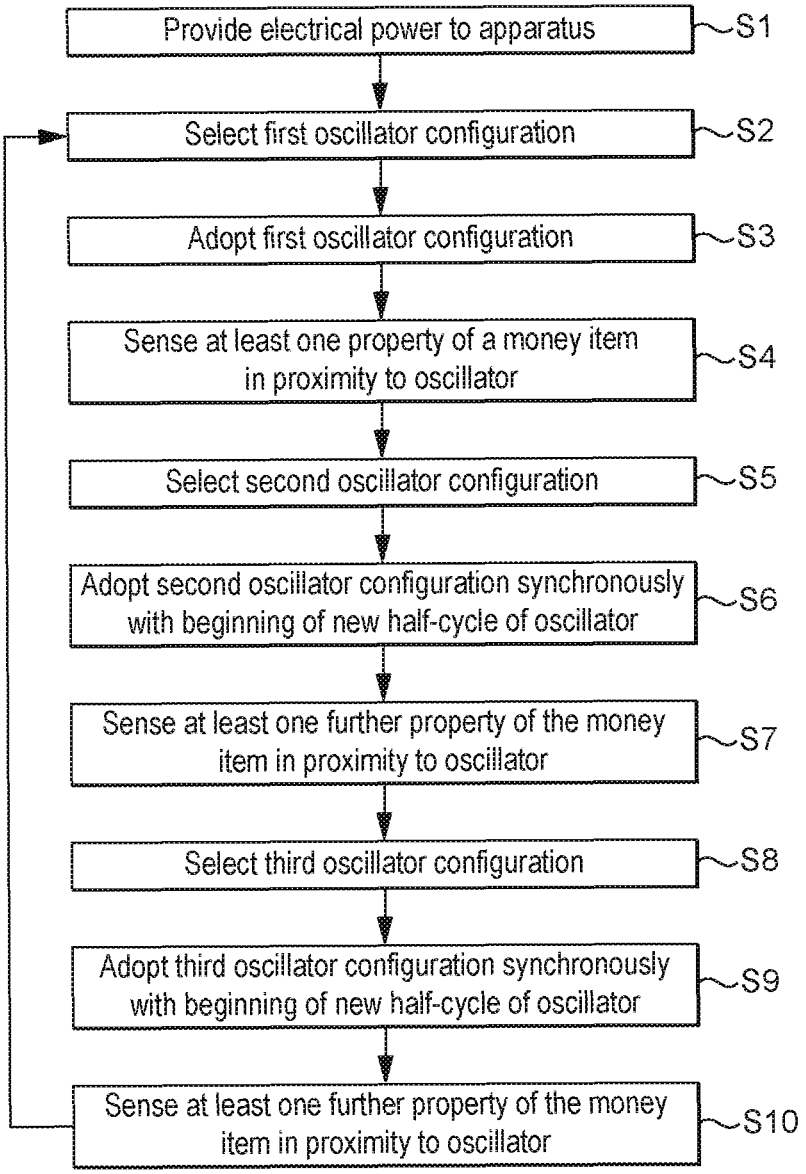
FIG. 5 is a flow diagram of a method of sensing the properties of a moving money item.

A method of operation of the apparatus 1 comprising the money item sensor 2 is described below with reference to FIGS. 4 and 5.

In a first step S1, the components of the apparatus 1, including the sensor 2, the controller 5 and the memory 8, receive electrical power from the power supply 9. The power supply 9 may, for example, be provided in the money item handling apparatus 1 and be coupled to a mains power source.

In a second step S2, the controller 5 selects a first base oscillating frequency f1 for the oscillator 3. The first base oscillating frequency f1 corresponds to a first configuration of the oscillator circuit 6. The first oscillating frequency f1 and/or circuit configuration is selected by the controller 5 and communicated to the sensor 2 via a communication coupling in between the controller 5 and the sensor 2. The controller 5 may be configured to select the oscillating frequency and/or circuit configuration based on a preset program stored in computer readable instructions in the memory 8. Communication between the controller 5 and the memory 8 may take place via a communication coupling 11, as shown in FIG. 1.

In a third step S3, the sensor 2 operates under the control of the controller 5 to cause the oscillator circuit 6 to adopt the first circuit configuration corresponding to the first base oscillating frequency f1. The adoption of the first circuit configuration may be made by operation of the switches 7 to connect and/or disconnect capacitive elements C1-3A/B to and/or from the oscillator circuit 6 in the manner described above. For example, in the first circuit configuration the switches 7 may couple a first capacitive element C1A&B to the money item sensing element L1. The adoption of the first circuit configuration causes any electrical energy stored in the recently connected capacitive elements C1-3A/B to be released into the oscillator circuit 6. The oscillator 3 is caused to oscillate at the first base frequency f1 and to generate a corresponding magnetic field in the region of the money item guide path 4 in the money item handling apparatus 1.

In a fourth step S4, if an electrically conductive money item such as a coin is present in the magnetic field generated by the oscillator 3, for example as the money item moves along the money item guide path 4 in the magnetic field generated by the oscillator 3, the electromagnetic effect of the money item in the magnetic field causes a fluctuation in the waveform of the oscillator 3. The fluctuation may be in the amplitude and/or frequency of the waveform of the oscillator 3. The fluctuation is relative to the normal amplitude and frequency f1 of the waveform when a money item is not present. The first oscillating frequency f1 may be particularly suitable for sensing one or more particular properties of the money item, such as one or more materials or arrangements of construction, and so the fluctuation may more strongly indicate these particular properties than other properties of the money item. The sensor 2 outputs an output signal to the controller 5 which is indicative of the fluctuations in the first oscillating frequency f1 so that the controller 5 can take readings from the output signal and determine the one or more particular properties of the money item associated with the first oscillating frequency f1.

In a fifth step S5, having taken readings from the output signal of the sensor 2 to determine the one or more first properties of the money item, the controller 5 selects a second base oscillating frequency f2 for the oscillator 3. This second base oscillating frequency f2 corresponds to a second configuration of the oscillator circuit 6 and may be particularly suitable for sensing one or more second, different properties of the money item, such as a different aspect of material construction. The second oscillating frequency f2 and/or circuit configuration is selected by the controller 5 and communicated to the sensor 2 in the manner previously described.

In a sixth step S6, the oscillator 3 receives an indication of the second configuration for the oscillator circuit 6 from the sensor 2 and, in response, triggers a change in the circuit configuration synchronously with the beginning of a new half-cycle in the oscillation of the oscillator 3. At this instant, the electrical current in the circuit 6 is zero. As has been explained above, the adoption of the second circuit configuration may be made by operation of the switches 7 to connect and/or disconnect capacitive elements C1-3A/B to and/or from the oscillator circuit 6. For example, in the second circuit configuration the switches 7 may couple a second capacitive element C2A&B to the money item sensing element L1.

The adoption of the second circuit configuration causes any electrical energy stored in the recently connected capacitive elements C1-3A/B to be released into the oscillator circuit 6. This means that the oscillator 3 immediately stabilises at the new base frequency f2, as previously explained, and generates a corresponding magnetic field in the region of the money item guide path 4 in the money item handling apparatus 1.

In a seventh step S7, the electromagnetic effect of the money item in the magnetic field causes a fluctuation in the second oscillating frequency f2 of the oscillator 3. The fluctuation may be similar in nature to the fluctuation described above in relation to the fourth step S4. The fluctuation may be strongly indicative of the one or more second properties of the money item referred to above. The sensor 2 outputs an output signal to the controller 5 which is indicative of the fluctuations in the second oscillating frequency f2 so that the controller 5 can take readings from the output signal and determine the one or more second properties of the money item associated with the second oscillating frequency f2.

In an eighth step S8, having taken readings from the output signal of the sensor 2 to determine the one or more second properties of the money item, the controller 5 selects a third base oscillating frequency f3 for the oscillator 3. The third base oscillating frequency f3 corresponds to a third configuration of the oscillator circuit 6 and may be particularly suitable for sensing one or more third, different properties of the money item, such as another aspect of material construction. The third oscillating frequency f3 and/or circuit configuration is selected by the controller 5 and communicated to the sensor 2 in the manner previously described.

In a ninth step S9, the oscillator 3 receives an indication of the third configuration for the oscillator circuit 6 from the sensor 2 and, in response, triggers a change in the circuit configuration synchronously with the beginning of a new half-cycle in the oscillation of the oscillator 3. At this instant, the electrical current in the circuit 6 is zero. The adoption of the third circuit configuration may be made by operation of the switches 7 to connect and/or disconnect capacitive elements C1-3A/B to and/or from the oscillator circuit 6. For example, in the third circuit configuration the switches 7 may couple a third capacitive element C3A&B to the money item sensing element L1.

The adoption of the third circuit configuration causes any electrical energy stored in the recently connected capacitive elements C1-3A/B to be released into the oscillator circuit 6. This means that the oscillator 3 immediately stabilises at the new base frequency f3, as previously explained, and generates a corresponding magnetic field in the region of the money item guide path 4 in the money item handling apparatus 1.

In a tenth step S10, the electromagnetic effect of the money item in the magnetic field causes a fluctuation in the third oscillating frequency f3 of the oscillator 3. The fluctuation may be similar in nature to the fluctuation described above in relation to the fourth step S4. The fluctuation may be strongly indicative of the one or more second properties of the money item referred to above. The sensor 2 outputs an output signal to the controller 5 which is indicative of the fluctuations in the third oscillating frequency f3 so that the controller 5 can take readings from the output signal and determine the one or more third properties of the money item associated with the third oscillating frequency f3.

The second to tenth steps S2-S10 may be repeated in a loop so that, whenever a money item passes along the guide path 4, its first, second and third properties will be sensed by the frequency-switching sensor 2 and communicated to the controller 5. The speed at which the sensor 2 is able to switch between stable oscillating states at different base frequencies means that many frequency transitions can take place whilst the moving money item is still in close proximity to the sensor 2 in a uniform region of the magnetic field. This contributes to the ability of the apparatus to use a single oscillator 3 for all measurements of the moving money item, rather than multiple oscillators in multiple sensors. As illustrated in FIG. 4, the sensor 2 may be able to switch between stable oscillating states in a period of less than 20 microseconds, such as a period of less than 10 microseconds.

It will be appreciated that the embodiments and alternatives described above can be used either singly or in combination. It will also be appreciated that alternatives which are not explicitly discussed above are within the scope of the invention. For example, although the controller 5 has been described here as being outside the sensor 2, it could alternatively be comprised within the sensor 2. It will also be appreciated that the specific components illustrated in FIG. 2 can be replaced with alternative components to achieve the same effects as the illustrated circuit.

Examples of money item handling systems 1 in which the sensor 2 may be used include automated payment systems, such as those used in retail locations for self check-outs. Other examples may be found in vending machines or gaming machines. The money items may comprise coins or other conductive disk-like tokens. The money items may be substantially circular, as in the case of coins, and may be metallic.

The invention claimed is:

1. An apparatus comprising:

a money item sensor comprising a resonant electrical oscillator circuit operable at a plurality of different oscillating frequencies to sense at least one property of a money item;

wherein the resonant electrical oscillator circuit is configured to trigger one or more switches to change an oscillating frequency by switching one or more capacitive components out of the resonant electrical oscillator circuit synchronously with a beginning of a new half-cycle of the resonant electrical oscillator circuit, wherein when switched out of the resonant electrical oscillator circuit the one or more capacitive components store electrical energy from the resonant electrical oscillator circuit; and wherein the resonant electrical oscillator circuit is configured to trigger said one or more switches to further change the oscillating frequency by switching said one or more capacitive components back into the resonant electrical oscillator circuit synchronously with a beginning of a further new half-cycle of the resonant electrical oscillator circuit, wherein upon said one or more capacitive components being switched back into the resonant electrical oscillator circuit to adopt a particular configuration of the resonant electrical oscillator circuit an amplitude of the oscillating frequency matches an amplitude of the oscillating frequency when the resonant electrical oscillator circuit was previously in the particular configuration.

2. The apparatus according to claim 1, wherein the resonant electrical oscillator circuit comprises an LC resonant circuit.

3. The apparatus according to claim 1, further comprising:

a controller configured to measure fluctuations in the oscillating frequency of the resonant electrical oscillator circuit caused by a money item in a magnetic field generated by the resonant electrical oscillator circuit to determine the at least one property of the money item.

4. The apparatus according to claim 1, further comprising a controller configured to:

measure a first fluctuation in the oscillating frequency of the resonant electrical oscillator circuit at a first base frequency of the resonant electrical oscillator circuit to determine a first property of a money item; and measure a second fluctuation in the oscillating frequency of the resonant electrical oscillator circuit at a second base frequency of the resonant electrical oscillator circuit to determine a second property of the money item following a change in a base oscillating frequency.

5. The apparatus according to claim 1, wherein the money item sensor is located in proximity to a money item guide path to determine the at least one property of the money item moving along the money item guide path.

6. The apparatus according to claim 1, wherein the money item is electrically conductive.

7. The apparatus according to claim 1, wherein the resonant electrical oscillator circuit is configured to trigger changes in the oscillating frequency synchronously with an instant of zero electrical current in the resonant electrical oscillator circuit.

8. The apparatus according to claim 7, further comprising:

one or more capacitors configured to, at the instant of zero electrical current, store electrical energy in the resonant electrical oscillator circuit.

9. The apparatus according to claim 1, further comprising a controller configured to select a new oscillating frequency of the oscillator.

10. The apparatus according to claim 9, wherein the controller is further configured to provide an indication of the new oscillating frequency to the oscillator.

11. The apparatus according to claim 10, wherein the resonant electrical oscillator circuit is configured to trigger a change to the new oscillating frequency in response to receiving the indication of the new oscillating frequency from the controller.

12. A method of sensing properties of money items, the method comprising:

causing, by a controller in a money item sensor comprising a resonant electrical oscillator circuit operable at a plurality of different oscillating frequencies, the resonant electrical oscillator circuit configured to:

trigger one or more switches to change an oscillating frequency by switching one or more capacitive components out of the resonant electrical oscillator circuit synchronously with a beginning of a new half-cycle of the resonant electrical oscillator circuit, wherein when switched out of the resonant electrical oscillator circuit the one or more capacitive components store electrical energy from the resonant electrical oscillator circuit; and trigger said one or more switches to further change the oscillating frequency by switching said one or more capacitive components back into the resonant electrical oscillator circuit synchronously with a beginning of a further new half-cycle of the resonant electrical oscillator circuit, wherein upon said one or more capacitive components being switched back into the resonant electrical oscillator circuit to adopt a particular configuration of the resonant electrical oscillator circuit an amplitude of the oscillating frequency matches an amplitude of the oscillating frequency when the resonant electrical oscillator circuit was previously in the particular configuration.

* * * * *